US006004899A

United States Patent [19]

Tachizawa

[11] Patent Number: 6,004,899

[45] Date of Patent: Dec. 21, 1999

[54] REVERSIBLE HEAT-SENSITIVE RECORDING MATERIAL

[75] Inventor: Shingo Tachizawa, Tokyo, Japan

[73] Assignee: Mitsubishi Paper Mills Limited, Tokyo, Japan

[21] Appl. No.: 09/046,533

[22] Filed: Mar. 24, 1998

[30] Foreign Application Priority Data

Mar. 26, 1997 [JP] Japan ..... 9-074006

[51] Int. Cl.[6] ..... B41M 5/30

[52] U.S. Cl. ..... 503/207; 428/405; 503/201

[58] Field of Search ..... 428/195, 331, 428/403–405; 503/201, 200, 226, 207

[56] References Cited

U.S. PATENT DOCUMENTS

| | | | |
|---|---|---|---|
| 5,395,815 | 3/1995 | Ikeda et al. | 503/216 |
| 5,731,262 | 3/1998 | Ogino et al. | 503/207 |

FOREIGN PATENT DOCUMENTS

| | | | |
|---|---|---|---|
| 492628A1 | 7/1992 | European Pat. Off. | 503/201 |
| 63-145090 | 6/1988 | Japan | 503/201 |
| 63-170081 | 7/1988 | Japan | 503/207 |
| 64-22589 | 1/1989 | Japan | 503/209 |

*Primary Examiner*—Bruce H. Hess
*Attorney, Agent, or Firm*—Pillsbury Madison & Sutro LLP

[57] ABSTRACT

Disclosed is a reversible heat-sensitive recording material having a support and a reversible heat-sensitive recording layer provided at least one surface of the support and containing a colorless or slightly colored leuco dye and a reversible color developing agent capable of causing a reversible change in color density of the dye due to the difference in cooling rate after heating, which may further have a protective layer provided on the reversible heat-sensitive recording layer, and an anchor layer provided between the support and the reversible heat-sensitive recording layer, characterized in that at least one of the reversible heat-sensitive recording layer, the protective layer and the anchor layer contains a pigment subjected to a surface-modifying treatment.

17 Claims, No Drawings

REVERSIBLE HEAT-SENSITIVE RECORDING MATERIAL

BACKGROUND OF THE INVENTION

1. Field of the Invention

This invention relates to reversible heat-sensitive recording materials in which formation of images and erasion of the images can be carried out by controlling the heat energy.

2. Prior Art

Heat-sensitive recording materials generally comprise a support and, provided thereon, a heat-sensitive recording layer mainly composed of a normally electron donating colorless or slightly colored dye precursor and an electron accepting color developer. The dye precursor and the color developer instantaneously react upon application of heat by thermal head, thermal pen, laser beams or the like to form an image. Such heat-sensitive recording materials are disclosed in Japanese Patent Application Kokoku Nos. 43-4160, 45-14039 and the like.

In general, in the case of these heat-sensitive materials, when an image is once formed, it is impossible to erase the image to restore the portion to the original state.

Therefore, for further recording of information, it is only possible to make recording in the portions where no image is formed. Accordingly, the area for heat-sensitive recording is limited and the information to be recorded is restricted and not all of the necessary information can be recorded.

Recently, reversible heat-sensitive recording materials capable of repeating the formation of images and the erasion of the images have been proposed for solving the above problems. For example, Japanese Patent Application Kokai Nos. 54-119377, 63-39377, 63-41186 and the like, disclose heat-sensitive recording materials comprising a matrix resin and an organic low-molecular compound dispersed in the matrix resin. However, in these recording materials, the transparency of the recording materials is reversibly changed and so the contrast between the imaged portion and the unimaged portion is insufficient.

Furthermore, according to the methods described in Japanese Patent Application Kokai Nos. 50-81157 and 50-105555, since the images formed by these methods change depending on the environmental temperatures, the temperature at which the image-formed state is maintained differs from the temperature at which the image-erased state is maintained and so these two states cannot be maintained for a desired period at room temperature.

Further, Japanese Patent Application Kokai No. 59-120492 mentions a method for maintaining the image-formed state and the image-erased state by keeping the recording material in the region of the hysteresis temperature utilizing the hysteresis characteristics of color forming components. However, this method has the defects that a heating source are needed for formation and erasion of images and besides, the temperature region at which the image-formed state and the image-erased state can be maintained is limited to the region of the hysteresis temperature. Thus, this method is still not sufficient for using the materials in the temperature environment of daily life.

In addition, Japanese Patent Application Kokai Nos. 2-188293 and 2-188294 and International Patent Publication No. WO90/11898 disclose reversible heat-sensitive recording media comprising a leuco dye and a color developing and decolorizing agent which causes color formation of the leuco dye upon heating and causes erasion of the color. The color developing and decolorizing agents are amphoteric compounds having an acidic group which causes color formation of the leuco dye and a basic group which causes decolorization of the leuco dye and they preferentially cause one of the color formation action of the acidic group and the decoloration action of the basic group by controlling the heat energy, thereby to perform the color formation and decolorization. However, according to this method, it is impossible to completely exchange the color forming reaction and the decolorizing reaction from each other only by control of heat energy and since both the reactions simultaneously take place at a certain ratio, sufficient color density cannot be obtained and besides the decolorization cannot completely performed. For this reason, a sufficiently high contrast of the image cannot be obtained. Moreover, since the decolorizing action of the basic group acts also on the color formed portion at room temperature, the density of the color formed portion inevitably decreases with time.

Furthermore, in Japanese Patent Application Kokai No. 5-124360, reversible heat-sensitive media which can form images and erase images by heating a leuco dye is described, and as an electron-receiving compound, there are exemplified an organic phosphoric acid compound, α-hydroxy-aliphatic carboxylic acid, aliphatic dicarboxylic acid and a specific phenol compound such as an alkylthiophenol, an alkyloxyphenol, an alkylcarbamoylphenol, alkyl gallate each having a carbon number of 12 or more, etc. However, in this recording media, coloring density is low or erasion of images becomes incomplete so that the two problems cannot be solved simultaneously and image stability with time is also not practically satisfied.

As explained above, according to the conventional technique, there have been no reversible heat-sensitive recording materials which can give good image contrast, can form images and erase the images and can maintain images having time stability under the daily environment.

The present inventor has found a novel reversible colorization agent which can give good image contrast, can form images and erase images and can maintain images having time stability under the daily environment and proposed in Japanese Patent Application Kokai No. 6-210954. However, in the reversible heat-sensitive recording materials having a recording layer which forms images by heating, it is recognized that the properties such as color developing, decolorizing and repeated properties thereof, etc. are effected by a binder resin or a pigment other than the color developing components, and depending on the kinds of the resin or pigments, there sometimes causes practical problems. That is, there are problems that in the reversible heat-sensitive recording materials, if forming images and erasing images are repeated many times at the same portion, reversible color developing agent particles are liable to aggregate by heat and pressure when heat is applied and lowering in coloring density and deterioration of a recording layer occur by the repeated use.

SUMMARY OF THE INVENTION

An object of the present invention is to provide reversible heat-sensitive recording materials which can form images and erase the images, is suffer from little damage due to repeated use of image formation and erasion and has good durability.

As a result of intensive research, the present inventor has attained the object by producing a reversible heat-sensitive recording material comprising a reversible heat-sensitive recording layer containing a normally colorless or slightly colored leuco dye and a reversible color developing agent capable of causing a reversible change in color density of said leuco dye due to the difference in cooling rate after heating, and further comprising an anchor layer and a protective layer depending on necessity, characterized in that at least one of the reversible heat-sensitive recording layer, the anchor layer and the protective layer contains a pigment subjected to a surface-modifying treatment.

DESCRIPTION OF THE PREFERRED EMBODIMENTS

A reversible heat-sensitive recording material utilizing the reaction between an electron donating dye precursor such as a leuco compound, etc. and a reversible color developing agent has a problem that durability of the recording layer is low since the reversible color developing agent has a relatively long chain aliphatic hydrocarbon group. For example, when coloring and decolorizing are repeated at the same portion, said portion is exposed to pressure of the thermal head and the heat source so that the reversible coloring material is aggregated or the reversible heat-sensitive recording layer is flown out to likely cause the trouble of breakage in the printing layer.

With regard to these reversible heat-sensitive recording layer, in the present invention, in addition to a leuco dye, a reversible color developing agent and a binder resin, a pigment subjected to a surface-modifying treatment is used. Main role of the binder resin and the pigment in the recording layer is to prevent aggregation of the reversible thermally color developing composition due to repeated use of coloring and decolorizing. By adding a pigment which is subjected to a surface-modifying treatment to the recording layer, durability with a repeated use of the recording material is improved so that lifetime of the same is markedly elongated without impairing coloring and decolorizing properties and the commercial value of the reversible heat-sensitive recording material is also improved.

The reason why the durability of the recording layer according to the present invention is improved is not sufficiently clear but it can be estimated that the pigment subjected to a surface-modifying treatment combines with a binder resin to markedly contribute for improvement of heat resistance and durability of the recording layer and provide an extremely high modulus of elasticity and excellent heat resistance at high temperatures without impairing adhesive effect, dispersibility, coloring property and erasion property inherently possessed by the binder resin. It can be also estimated that the problem of aggregating the reversible color developing particles in the recording layer can be prevented by these characteristics so that the quality of the material is improved.

The reversible color developing particles are likely aggregated by the effects of deforming the surrounding binder resin due to the temperature and pressure at applying heat which leads to lowering in coloring property. However, when the pigment subjected to a surface-modifying treatment is added, heat resistant characteristics of the binder resin are improved and the reversible color developing agent particles are not affected by the binder resin. Thus, even when it is used for a long period of time, the reversible color developing agent particles maintain their properties at the initial stage.

It is also extremely effective that these pigments subjected to a surface-modifying treatment are added not only to the reversible heat-sensitive recording layer but also an anchor layer provided between the reversible heat-sensitive recording layer and the support, or a protective layer provided on the surface of the reversible heat-sensitive recording layer directly or via an intermediate layer.

The pigment subjected to a surface-modifying treatment which is added to the anchor layer improves heat resistance of the anchor layer itself so that a reversible heat-sensitive recording material having good durability is obtained, which is hardly destroyed by heat due to repeated use of coloring and decolorizing without impairing color formation and decolorization of the reversible heat-sensitive recording material.

Also, the pigment subjected to a surface-modifying treatment which is added to the protective layer prevents the surface from deformation or color change due to heat and pressure at applying heat for color formation and has a role of improving heat matching properties, friction resistance, etc. On the other hand, when an unmodified pigment is used in the protective layer, improvement in heat resistance with a some extent can be expected but lowering in gloss at the surface is remarkable. Also, stain is likely attached at repeated printing so that there is a problem of inferior in scratch resistance whereby a problem for practical use occurs.

When the pigment subjected to a surface-modifying treatment is used in the respective layers, heat resistance and adhesive properties between layers are improved so that it is preferably used in the respective layers.

The pigment subjected to a surface-modifying treatment according to the present invention means a pigment in which at least part of the pigment surface is coated by a surface modifier. The surface modifier referred to in the present specification indicates, in a complex system of an inorganic material and an organic material, or mixture of heterogeneous organic materials, a material which improve affinity of both materials accompanying with a chemical reaction of the surface modifier, and the surface modifier causes a chemical reaction with at least one surface among the two kinds of the materials and reacts with the others by chemical bonding or has an effect of improving chemical affinity. Thus, a pigment dispersant (a surfactant) which does not induce chemical bonding to both of the materials and simply improve affinity thereof is not included in the surface modifier according to the present invention.

As the surface modifier in the present invention, those which causes at least chemical bonding with a pigment are preferred, and a silane coupling agent, a titanate coupling agent, or an aluminum series coupling agent are particularly preferred. As these coupling agents, those which have been conventionally known materials can be used.

Examples of the silane coupling agent may include vinyl silane compounds such as vinyl triethoxysilane, vinyl trichlorosilane, vinyl trimethoxysilane, vinyl tris(β-methoxy-ethoxy) silane, γ-methacryloxypropyltrimethoxysilane, and γ-methacryloxypropyldimethoxysilane; epoxysilane compounds such as β-(3,4-epoxycyclohexyl) ethyltrimethoxysilane, γ-glycidoxypropyltrimethoxysilane, and γ-glycidoxypropylmethyldiethoxysilane; aminosilane compounds such as γ-aminopropyltriethoxysilane, γ-aminopropyltrimethoxysilane, N-β-(aminoethyl)-γ-aminopropyltrimethoxysilane, N-β-(aminoethyl)-γ-aminopropyldimethoxysilane, and γ-phenylaminopropyltrimethoxysilane; and reactive silane compounds such as γ-mercaptopropyltrimethoxysilane, γ-isocyanatepropyltriethoxysilane, γ-methacryloxypropyltriethoxysilane, and ureidopropyltriethoxysilane, etc.

Examples of the titanate coupling agent may include isopropyltriisostearoyltitanate, isopropyltris(dioctylpyrophosphate)titanate, isopropyltri(N-aminoethyl-aminoethyl)-titanate, tetraoctylbis(ditridecylphosphate)titanate, tetra(2,2-diallyloxymethyl-1-butyl)bis(ditridecyl)phosphatetitanate, bis(dioctylpyrophosphate)oxyacetatetitanate, and bis(dioctylpyrophosphate)ethylenetitanate, etc.

Examples of the aluminum series coupling agent may include acetalkoxyaluminum diisopropylate, etc.

Surface modifying treatment of the pigment by using a surface modifier can be carried out by spraying a solution containing the surface modifier in which the surface modifier is dissolved in a suitable solvent to a pigment while stirring the pigment, and drying the resulting material to remove the solvent, if necessary. When the surface modifier is a liquid state, it can be used as such. Also, the treatment can be performed by adding the surface modifier directly to a pigment dispersion (or slurry). Or else, the treatment can be performed by stirring the pigment and the surface modifier under heating in a powder mixer. It is also possible to use these materials by adding the surface modifier and an untreated pigment to a coating solution for forming a layer such as an anchor layer forming solution, a reversible heat-sensitive recording layer forming solution, a protective layer forming solution, etc.

An amount of the surface modifier to be attached to the pigment is preferably 0.1 to 20% by weight, more preferably 0.1 to 10% by weight, further preferably 1 to 7% by weight based on the weight of the pigment. The surface modifier may be used alone or in combination of two or more kinds. It is also possible to use the commercially available pigment which is subjected to surface-modifying treatment as such.

Examples of the pigments in accordance with the present invention may include inorganic pigments such as zinc oxide, titanium oxide, magnesium oxide, alumina, calcium carbonate, aluminum hydroxide, magnesium hydroxide, barium sulfate, lithopone, diatomaceous earth, talc, kaolin, calcined kaolin, magnesium carbonate, agalmatolite, silica, amorphous silica, colloidal silica, etc.; and plastic pigments such as urea-formalin resin, styrene-maleic acid resin copolymer, polyethylene, polypropylene, polyamide (such as Nylon, trade name), etc. of these, in the present invention, silica, kaolin, talc and titanium oxide are preferred. Among these, silica is particularly suitably used since it has a large effect of surface modification due to the coupling agent, particularly it has a high reactivity with a silane coupling agent having a mercapto group.

These pigments are usually used as fine powder having an average particle size of 20 $\mu$m or less, preferably 5 $\mu$m or less, more preferably 1 $\mu$m or less. Also, the pigment subjected to surface-modifying treatment and an unmodified pigment may be used in combination. In this case, the ratio of the surface-modified pigment in the total amount of the pigments is preferably 10% by weight or more.

In the present invention, the pigment treated by the surface modifier is used in combination with a binder resin. Specific examples of the binder resin to be used may include polyvinyl chloride, polyvinyl acetate, vinyl chloride-vinyl acetate copolymer, vinyl chloride-vinyl acetate-vinyl alcohol copolymer, vinyl chloride-vinyl acetate-maleic acid copolymer, vinyl chloride-acrylic acid ester copolymer, polyvinylidene chloride, vinylidene chloride-vinyl chloride copolymer, vinylidene chloride-acrylonitrile copolymer, various kinds of polyesters, various kinds of polyamides, various kinds of polyacrylates, various kinds of polymethacrylates, acrylate-methacrylate copolymer, silicone resin, nitrocellulose, polypropylene, starches, hydroxyethyl cellulose, methyl cellulose, carboxymethyl cellulose, gelatin, casein, polyvinyl alcohol, modified polyvinyl alcohol, sodium polyacrylate, acrylamide-acrylate copolymer, acrylamide-acrylate-methacrylate terpolymer, styrene-maleic anhydride copolymer, ethylene-maleic anhydride copolymer, polyurethane, styrene-butadiene copolymer, acrylonitrile-butadiene copolymer, methyl acrylate-butadiene copolymer, ethylene-vinyl acetate copolymer, urea-formalin resin, and phenol resin, but the present invention is not limited by these materials.

The total amount of the pigments including the surface-modified pigment and unmodified pigment to be used in the present invention is preferably 0.05 to 5 times the total weight of the binder resin, more preferably 0.1 to 2 times, particularly preferably 0.2 to 0.5 times.

The leuco dye to be used in the present invention include those generally used in a pressure-sensitive recording paper or a heat-sensitive recording paper, but is not particularly limited by these materials. Specific examples may include those as mentioned below but the present invention is not limited by these.

(1) Triarylmethane Type Compounds 3,3-Bis(p-dimethylaminophenyl)-6-dimethylaminophthalide (Crystal violet lactone), 2,2-bis(p-dimethylaminophenyl)-phthalide, 2-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3-p-dimethylaminophenyl-3-(1-methylpyrrol-2-yl)-6-dimethylaminophthalide, etc.

(2) Diphenylmethane Type Compounds 4,4'-Bis(dimethylaminophenyl)benzhydrylbenzyl ether, N-chlorophenyl leucoauramin, N-2,4,5-trichlorophenyl leucoauramin, etc.

(3) Xanthene Type Compounds

Rhodamin B anilinolactam, Rhodamin B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)-fluoran, 3-diethylamino-7-(2-chloroanilino)fluoran, 3-diethylamino-6-methyl-7-anilinofluoran, 3-(N-ethyl)tolylamino-6-methyl-7-anilinofluoran, 3-piperidino-6-methyl-7-anilinofluoran, 3-(N-ethyl)tolylamino-6-methyl-7-phenethylfluoran, 3-diethylamino-7-(4-nitroanilino)fluoran, 3-dibutylamino-6-methyl-7-anilinofluoran, 3-(N-methyl)propylamino-6-methyl-7-anilinofluoran, 3-(N-ethyl)isoamylamino-6-methyl-7-anilinofluoran, 3-(N-methyl)cyclohexylamino-6-methyl-7-anilinofluoran, 3-(N-ethyl)tetrahydrofurylamino-6-methyl-7-anilinofluoran, etc.

(4) Thiazine Type Compounds

Benzoylleucomethylene blue, p-nitrobenzoylleucomethylene blue, etc.

(5) Spiro Type Compounds

3-Methylspirodinaphthopyran, 3-ethylspirodinaphthopyran, 3,3-dichlorospirodinaphthopyran, 3-benzylspirodinaphthopyran, 3-methylnaphtho-3-(3-methoxybenzo)spiropyran, 3-propylspirobenzopyran, etc.

The normally colorless or slightly colored leuco dyes may be used each alone or in combination of two or more.

The reversible color developing agent to be used in the present invention may include, for example, those represented by the following formula (I), but the present invention is not limited by them. It is not particularly limited so long as the compound which causes reversible change in color tone to the leuco dye by heating, and an electron accepting compounds represented by the following formula (I) including a reversible color developing agent comprising a phenolic compound proposed in Japanese Patent Application Kokai No. 6-210954 by the present inventor is preferably used.

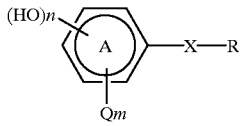

(I)

wherein n represents an integer of 1, 2 or 3; m represents 0, 1 or 2; Q represents an aliphatic hydrocarbon group, an alkoxy group or a halogen atom; the ring represented by A is an aromatic ring; X represents a divalent group containing 2 or more hetero atoms, a divalent group containing a nitrogen atom and binds to the aromatic ring represented by A through a hydrocarbon group having 1 or more carbon atoms, or a divalent group containing an unsaturated bond or an aromatic ring; and R represents an aliphatic hydrocarbon group.

Among the atoms contained in X and R, total number of atoms excluding hydrogen atoms and atoms constituting the aromatic ring is 8 or more. Specific examples of the substituent represented by Q may include an aliphatic hydrocarbon group such as a methyl group, an ethyl group, a propyl group, an isopropyl group, a n-butyl group, a t-butyl group, a t-pentyl group, a 2-ethylhexyl group, a cyclohexyl group and an allyl group; an alkoxy group such as a methoxy group, an ethoxy group, a n-propyloxy group, an i-propyloxy group, a n-butyloxy group and a n-octyloxy group; and a halogen atom such as fluorine, chlorine, bromine and iodine.

Examples of the divalent group represented by X which binds to the aromatic ring represented by A through a nitrogen atom may include —NHCO—, —NH—, —NHCONH—, —NHCONHNH—, —N=CH—, —N=N—, —$NHSO_2$—, —NHCO(p-$C_6H_4$)NHCO—, —NHCO(p-$C_6H_4$)NHCONH—, —NHCO(p-$C_6H_4$)NHCOCONH—, —NHCO(p-$C_6H_4$)CONH—, —NHCO(p-$C_6H_4$)CONHNHCO—, —NHCO(p-$C_6H_4$)OCONH—, —NHCO(p-$C_6H_4$)NHCOO—, —$NHCOCH_2$(m-$C_6H_4$)NHCO—, —$NHCOCH_2$(p-$C_6H_4$) —NHCO—, —$NHCOCH_2$(p-$C_6H_4$)NHCONH—, —$NHCOCH_2$(p-$C_6H_4$)NHCOCONH—, —$NHCOCH_2$(p-$C_6H_4$)CONH—, —$NHCOCH_2$(p-$C_6H_4$)CONHNHCO—, —$NHCOCH_2$(p-$C_6H_4$)CONHNH—CONH—, —$NHCOCH_2$(p-$C_6H_4$)CONHNHCOO—, —$NHCOCH_2$(p-$C_6H_4$)OCONH—, —$NHCOCH_2$(p-$C_6H_4$)NHCOO—, —$NHCOCH_2CH_2$(p-$C_6H_4$)NHCO—, —$NHCOCH_2CH_2$(p-$C_6H_4$)NHCONH—, —$NHCOCH_2CH_2$(p-$C_6H_4$)NHCOO—, —$NHCOCH_2CH_2$(p-$C_6H_4$)NHCOCONH—, —$NHCOCH_2CH_2$(p-$C_6H_4$)CONH—, —$NHCOCH_2CH_2$(p-$C_6H_4$)CONHNHCO—, —$NHCOCH_2CH_2$(p-$C_6H_4$)CONHNHCONH—and the like. When a hydrogen atom binds to the nitrogen atom, the hydrogen atom may be substituted by an aliphatic hydrocarbon group such as a methyl group or a cyclohexyl group, etc. Among these, a urea bond is more preferred in the points of decolorizing property or an image concentration. When X is —CONH—, —COO—or —S—, either of the color disappearing property or a density of the image will be insufficient.

Examples of the divalent group represented by X containing 2 or more hetero atoms may include —$SO_2$NH—, —S—S—, —CONHNH—, —CONHNHCO, —$CONHCH_2$CO—, —CONHNHCOO—, —$CONHCH_2$COO—, —CONHNHCONH—, —$CONHCH_2$CONH—, —CONHNHCONHNH—, —$CONHCH_2$CONHNH—, —$CH_2$NHCONH—, —$CH_2CH_2$NHCONH—, —$CH_2CH_2CH_2$NHCONH—, —$SCH_2$CONH—, —$SCH_2CH_2$CONH—, —S($CH_2$)$_5$CONH—, —S($CH_2$)$_{10}$CONH—, —S(p-$C_6H_4$)CONH—, —$SCH_2$NHCO—, —$SCH_2CH_2$NHCO—, —S($CH_2$)$_6$CONH—, —S(p-$C_6H_4$)NHCO—, —$SCH_2$NHCONH—, —$SCH_2CH_2$NHCONH—, —S($CH_2$)$_6$NHCONH—, —S(p-$C_6H_4$)NHCONH—, —S($CH_2$)$_{10}$NHCONH—, —$SCH_2CH_2$NHCOO—, —S($CH_2$)$_6$NHCOO—, —S(p-$C_6H_4$)NHCOO—, —S($CH_2$)$_6$OCONH—, —S(p-$C_6H_4$)OCONH—, —S($CH_2$)$_{11}$OCONH—, —$SCH_2CH_2$CONH—, —S($CH_2$)$_5$CONH—, —$SCH_2CH_2$NHCO(p-$C_6H_4$)—, —$SCH_2$CONHNHCO—, —$SCH_2CH_2$CONHNHCO—, —S($CH_2$)$_6$CONHNHCO—, —S($CH_2$)$_6$CONHNHCO(p-$C_6H_4$)—, —S($CH_2$)$_{10}$CONHNHCO—, —S(p-$C_6H_4$)CONHNHCO—, —$SCH_2$(p-$C_6H_4$)CONHNHCO—, —$SCH_2CH_2$NHCOCONH—, —$SCH_2CH_2CH_2$NHCOCONH—, —S($CH_2$)$_{11}$NHCOCONH—, —S(p-$C_6H_4$)NHCOCONH—, —$SCH_2$CONHCONH—, —$SCH_2CH_2$CONHCONH—, —S(p-$C_6H_4$)CONHCONH—, —$SCH_2CH_2$NHCONHCO—, —S(p-$C_6H_4$)NHCONHCO—, —$SCH_2CH_2$CONHNHCONH—, —S($CH_2$)$_{10}$CONHNHCONH—, —$SCH_2CH_2$NHNHCONH—, —S(p-$C_6H_4$)NHNHCONH—, —$SCH_2CH_2$NHCONHNH—, —S(p-$C_6H_4$)NHCONHNH—, —$SCH_2$CONHCONHNH—, —$SCH_2CH_2$CONHCONHNH—, —S($CH_2$)$_{10}$CONHCONHNH—, —S(p-$C_6H_4$)CONHNHCONH—, —S(p-$C_6H_4$)CONHCONHNH—, —$SCH_2$CONHCONHNHCO—, —$SCH_2CH_2$CONHCONHNHCO—, —S($CH_2$)$_{10}$CONHCONHNHCO—, —S(p-$C_6H_4$)CONHNHCONHCO—, —S(p-$C_6H_4$)CONHCONHNHCO—, —$SCH_2$CONH($CH_2$)NHCO—, —$SCH_2CH_2$CONH($CH_2$)NHCO—, —S(P-$C_6H_4$)CONH(CH2)NHCO—, —S($CH_2$)$_{10}$CONH($CH_2$)NHCO—, —$SCH_2$CON($CH_2$)NHCONH—, —$SCH_2CH_2$CON($CH_2$)NHCONH—, —S($CH_2$)$_{10}$CONHCONH($CH_2$)NHCO—, —S(p-$C_6H_4$)CONH($CH_2$)NHCO—, —$SCH_2CH_2$NHCONH($CH_2$)NHCO—, —$SCH_2CH_2$NHCO$CH_2$CONH—, —S(p-$C_6H_4$)NHCONH($CH_2$)NHCO—, —S(p-$C_6H_4$)NHCO$CH_2$CONH— and the like. Specific examples of the hetero atoms may include an oxygen atom, a nitrogen atom, a sulfur atom, a phosphorus atom, a boron atom, a silicon atom, a selenium atom, a tin atom and the like.

Examples of X which is a divalent group containing an unsaturated bond or an aromatic ring may include a group which contains —CH=CH—, —CH=N—, —$SO_2$—, a phenylene group, a carbon-carbon triple bond and the like, a group in which the above groups are combined, and a group in which at least one of the linking groups such as —NHCO—, —NH—, —NHCONH—, —NHCSNH—, —N=CH—, —N=N—, —$NHSO_2$—, —$SO_2$NH—, —S—S—, etc. which are mentioned as the other examples of X are combined with one end or both ends of the above-mentioned groups. In this case, as the other linking groups, a divalent group such as —CONH—, —O—, —S—, —COO—, —OCO—, —OCOO—, —CO—, —$SO_2$—, etc. may be mentioned.

Example of X which is a divalent group containing a nitrogen atom and being bound by an aromatic ring represented by A and a hydrocarbon group having 1 or more carbon atoms may include —$CH_2$CONH—, —$CH_2CH_2$CONH—, —$CH_2$NHCO—, —$CH_2CH_2$NHCO—, —$CH_2CH_2CH_2$NHCO—, —$CH_2CH_2$NHCOO—, -$(CH_2)_6$NHCOO—, -(p-$C_6H_4$)NHCOO—, —$CH_2CH_2$OCONH—, -$(CH_2)_{11}$OCONH—, -(p-$C_6H_4$)OCONH—, —$CH_2CH_2$CONHCO—, —$(CH_2)_5$CONHCO—, —$CH_2CH_2$CONHCO(p-$C_6H_4$)-, —$CH_2$CONHNHCO—, —$CH_2CH_2$CONHNHCO—, -$(CH_2)_5$CONHNHCO—, -(CH2)$_5$CONHNHCO(p-$C_6H_4$)-, -$(CH_2)_{10}$CONHNHCO—, -(p-$C_6H_4$)CONHNHCO—, —$CH_2$(p-$C_6H_4$)CONHNHCO—, —$CH_2CH_2$NHCOCONH—, —$CH_2CH_2CH_2$NHCOCONH—, -$(CH_2)_{10}$NHCOCONH—, -(p-$C_6H_4$)NHCOCONH—, —$CH_2$CONHCONH—, —$CH_2CH_2$CONHCONH—, -(p-$C_6H_4$)CONHCONH—, —$CH_2CH_2$NHCONHCO—, -(p-$C_6H_4$)NHCONHCO—, —$CH_2CH_2$NHCO- NHMH—, -(p-$C_6H_4$)NHCONHNH—, —$CH_2$CONHNHCONH—, —$CH_2CH_2$CONHNHCONH—, -$(CH_2)_{10}$CONHNHCONH—, -(p-$C_6H_4$)NNNHCO—, —$CH_2$CONHCH$_2$NHCO—, —$CH_2$—$CH_2$CONHCH$_2$NHCO—, -$(CH_2)_{10}$CONHCH$_2$NHCO—, -(p-$C_6H_4$)CONHCH$_2$NHCO—, —$CH_2$CONHCH$_2$NHCONH—, —$CH_2CH_2$CONHCH$_2$NHCONH—, -$(CH_2)_{10}$CONHCH$_2$NH CONH—, -(p-$C_6H_4$)CONHCH$_2$NHCONH—, —$CH_2CH_2$NHCONHCH$_2$NHCO—, -(p-$C_6H_4$)NHCONHCH$_2$NHCO—, —$CH_2CH_2$NHCOCH$_2$CONH—, -(p-$C_6H_4$)NHCOCH$_2$CONH—, and the like.

Examples of the aliphatic hydrocarbon group represented by R may include a hexyl group, an octyl group, a nonyl group, a cyclohexyl group, a decyl group, an undecyl group, a dodecyl group, a cyclododecyl group, a tridecyl group, a tetradecyl group, a pentadecyl group, a hexadecyl group, a heptadecyl group, a 16-methylheptadecyl group, an octadecyl group, a 9-octadecenyl group, a nonadecyl group, an eicosyl group, a heneicosyl group, a docosyl group, a tricosyl group, a tetracosyl group, a 2-norbornyl group, a 7,7-diemthylnorbornyl group, a 1-adamantyl group, a cholesteryl group, a 5-phenylpentyl group, and the like. These groups may be branched, polycondensed to form a fused ring or may contain an unsaturated bond. However, it is necessary for decolorizing property that the total number of atoms constituting X and R except for the hydrogen atoms and atoms constituting the aromatic ring is 8 or more, particularly 14 or more.

Next, specific examples of the reversible color developing agent to be preferably used in the present invention are mentioned but the present invention is not limited by them. 4'-Hydroxyheptananilide, 4'-hydroxy-3-methyloctananilide, 4'-hydroxynanodecananilide, 3'-hydroxynanodecananilide, 4'-hydroxy-10-octadecenanilide, 15-cyclohexyl-4'-hydroxypentadecananilide, 4'-hydroxy-5-tetradecenanilide, 3'-cyclo-hexyl-4'-hydroxyheptadecananilide, 3'-allyl-4'-hydroxypentadecananilide, 3'-chloro-4'-hydroxyoctadecaneanilide, 3'-hydroxydodecananilide, 2',4-dihydroxyheptadecananilide, 4'-hydroxy-4-hexylbenzanilide, 4'-hydroxy-4-octadecylbenzanilide, 4'-hydroxy-4-pentadecylaminocarbonylbenzanilide, 4'-hydroxy-4-hexylcarbonylaminobenzanilide, 4'-hydroxy-4-(heptylthio)benzanilide, 4'-hydroxy-4-octadecyloxybenzanilide, 4'-hydroxy-4-dodecylsulfonylbenzanilide, 4'-hydroxy-4-nonylsulfonyloxynenzanilide, 4'-hydroxy-4-dodecyloxysulfonylbenzanilide, 4'-hydroxy-4-pentadecylaminosulfonylbenzanilide, 4'-hydroxy-4-(N-heptadecylideneamino)benzanilide, 4'-hydroxy-3,4-dioctyloxybenzanilide, 4'-hydroxy-3-octyl-4-(octylthio)benzanilide, 4'-hydroxy-3-(heptadecylthio)-5-pentadecyloxybenzanilide, 4'-hydroxy-3-heptadecylcarbonylamino-5-dodecylbenzanilide, 4'-hydroxy-3-octadecylaminocarbonyl-5-tetradecylaminocarbonylbenzanilide, 4'-hydroxy-3-octadecylsufonylamino-5-octadecyloxybenzanilide, 4'-hydroxy-3-heptadecyloxysulfonyl-5-tetradecyloxysulfonylbenzanilide, 4'-hydroxy-3,5-bis(N-docosylideneamino)benzanilide, 4'-hydroxy-4-octadecylcarbonylaminobenzanilide, 4'-hydroxy-3-octadecylcarbonylamino-5-octadecyloxybenzanilide, 3'-allyl-4'-hydroxy-4-pentadecylbenzanilide, 4'-hydroxy-3'-methyl-4-nonyloxybenzanilide, 4'-hydroxy-3'-propyl-4-nonadecylcarbonyloxybenzanilide, 3'-butyl-4'-hydroxy-4-octadecyloxycarbonylbenzanilide, 3'-hydroxy-4-pentadecylcarbonyloxybenzanilide, 3'-hydroxy-4-nonadecylsulfonylbenzanilide, 3',4',5'-trihydroxy-4-tetracosylaminosulfonylbenzanilide, 3',5'-dihydroxy-4-pentacosylaminocarbonylbenzanilide, 3'-hydroxy-4-(N-dodecylideneamino)benzanilide, N- [4-(3-hydroxyphenylaminocarbonyl)benzilidene] pentadecylamine, N-cyclohexyl-4-hydroxybenzhydrazide, N-cyclohexylmethyl-4-hydroxybenzhydrazide, N-cyclohexyl-4-hydroxybenzamide, N-cyclohexylmethyl-4-hydroxybenzamide, N-methyl-N-octadecyl-4-hydroxybenzamide, N-(3-methylhexyl)-4-hydroxybenzamide, N-octadecyl-4-hydroxybenzhydrazide, N-(8-octadecenyl)-4-hydroxybenzamide, 4-hydroxy-4'-dodecylbenzanilide, N-methyl-4-hydroxy-4'-octadecylbenzanilide, 4-hydroxy-4'-octadecyloxybenzanilide, 4-hydroxy-4'-(octadecylthio)benzanilide, 4-hydroxy-4'-hexadecylcarbonylbenzanilide, 4-hydroxy-4'-heptadecyloxycarbonyloxybenzanilide, 4-hydroxy-4'-dodecyloxycarbonylbenzanilide, 4-hydroxy-4'-heptadecylcarbonyloxybenzanilide, 4-hydroxy-4'-cyclohexylaminobenzanilide, 4-hydroxy-4'-octadecylaminobenzanilide, 4-hydroxy-4'-heptadecylcarbonylaminobenzanilide, 4-hydroxy-4'-octadecylaminocarbonylbenzanilide, 4-hydroxy-4'-dodecylsulfonylbenzanilide, 4-hydroxy-4'-octadecyloxysulfonylbenzanilide, 4-hydroxy-4'-dodecylsulfonyloxybenzanilide, N-4-hydroxybenzoyl-N'-octadecylidene-1,4-phenylenediamine, N-4-(4-hydroxyphenylcarbonylamino)benzylidenedodecylamine, 4-hydroxy-4'-tetradecyloxycarbonylaminobenzanilide, 4-hydroxy-4'-octadecylureylenebenzanilide, 3-hydroxy-4'-dodecyloxybenzanilide, N-methyl-4-hydroxy-3'-octadecyloxybenzanilide, 3-hydroxy-4'-tetradecylbenzanilide, N-methyl-3-hydroxy-4'-octadecylbenzanilide, N-dodecyl-4-hydroxy-3-methylbenzamide, 3-methoxy4-hydroxy-4'-octadecyloxybenzanilide, 3-chloro-4-hydroxy-4'-octadecylbenzanilide, N-octadecyl-4-hydroxy-2,5-dimethylbenzamide, 4-hydroxy-4'-octadecyloxy-3'-chlorobenzanilide, 4-hydroxy-3',4'-didecyloxybenzylanilide, 4-hydroxy-3'-octadecylamino-4'-octadecyloxybenzanilide, 4hydroxy-2'-chloro-3',5'-didecyloxybenzanilide, 4-hydroxy-3',4'-dioctadecyloxybenzanilide, 4-hydroxy-4'-octyl-3'- methylbenzanilide, 3-hydroxy-4-methyl-4'-tetradecylbenzanilide, N-methyl-4-hydroxy-3'-octadecylbenzanilide, 4- (N-octadecylsulfonylamino) phenol, 4-(N-methyl-N-octadecylsulfonylamino)phenol, 4-(N-3-methylhexylsulfonylamino)phenol, 4'-hydroxy-4-cyclohexylbenzenesulfonanilide, 4'-hydroxy-4-octadecyloxybenzenesulfonanilide, 4'-hydroxy-4-(dodecylthio)benzenesulfonanilide, 4'-hydroxy-4-hexylcarbonylbenzenesulfonanilide, 4'-hydroxy-4-(8-heptadecenyl)carbonylbenzenesulfonanilide, 4'-hydroxy-4-octyloxycarbonyloxybenzenesulfonanilide, 4'-hydroxy-4-dodecylcarbonyloxybenzenesulfonanilide, 4'-hydroxy-4-octadecylaminobenzenesulfonanilide, 4'-hydroxy-4-heptadecylcarbonylaminobenzenesulfonanilide, 4'-hydroxy-4-dodecylcarbonylbenzenesulfonanilide, 4'-hydroxy-4-dodecylsulfonylbenzenesulfonanilide, 4'-hydroxy-4-octadecyloxysulfonylbenzenesulfonanilide, 4'-hydroxy-4-dodecylsulfonyloxybenzenesulfonanilide, N-dodecylidene-4-(4-hydroxyphenyl)aminosulfonylaniline, N-4-(4-hydroxyphenylaminosulfonyl)benzylideneoctadecylamine, 4'-hydroxy-4-octyloxycarbonylaminobenzenesulfonanilide, 4'-hydroxy-4-octadecyloxycarbonylaminobenzenesulfonanilide, 4'-hydroxy-4-octadecylureylenebenzenesulfonanilide, N-methyl-4'-hydroxy-3-octadecyloxybenzenesulfonanilide, 3'-hydroxy-4-dodecylbenzenesulfonanilide, 3-methyl-4-(N-dodecylsulfonamino)phenol, 3'-methoxy-4'-hydroxy-4-octadecyloxybenzenesulfonanilide, 3'-chloro-4'-hydroxy-4-octadecylbenzenesulfonanilide, 4'-hydroxy-2,5-dimethyl-4-octadecylbenzenesulfonanilide, 3-methyl-4-(N-octadecylsulfonamino)phenol, 4'-dihydroxy-3,4-dioctadecyloxybenzenesulfonanilide, 1-(4-hydroxyphenyldithio)octadecane, 1-(4-hydroxyphenyldithio)-9-octadecene, 1-(2-fluoro-4-hydroxyphenyldithio)octadecane, 1-(2-ethoxy-4-hydroxyphenyldithio)octadecane, 1-(3-chloro-4-hydroxyphenyldithio)octadecane, 4'-hydroxy-4-tetradecyldiphenylsulfide, 4'-hydroxy-4-octadecyldiphenylsulfide, 4'-hydroxy-4-octadecylcarbonylaminodiphenylsulfide, 4'-hydroxy-4-octadecyloxydiphenylsulfide, 4'-hydroxy-4-octadecyloxysulfonyl-diphenylsulfide, 4'-hydroxy-4-octadecylsulfonylaminodiphenylsulfide, 4'-hydroxy-3,4-didecyloxydiphenylsulfide, 4'-hydroxy-3,4-dioctadecyloxydiphenylsulfide, 4-(15-cyclohexylpentadecyl)-4'-hydroxydiphenylsulfide, 4'-hydroxy-4-(5-tetradecenyl)diphenylsulfide, 3'-chloro-4'-hydroxy-4-octadecyldiphenylsulfide, 3'-hydroxy-4-dodecyldiphenylsulfide, 3'-hydroxy-4-octadecyldiphenylsulfide, 3'-hydroxy-4-dodecyloxycarbonyldiphenylsulfide, N-(4-hydroxyphenyl)-N'-hexylurea, N-(4-hydroxyphenyl)-N'-dodecylurea, N-(4-hydroxyphenyl)-N'-hexadecylurea, N-(4-hydroxyphenyl)-N'-octadecylurea, N-(4-hydroxyphenyl)-N'-eicosylurea, N-(4-hydroxyphenyl)-N'-cyclododecylurea, N-(4-hydroxyphenyl)-N'-docosylurea, N-(4-hydroxyphenyl)-N'-cholesterylurea, hydroxyphenyl)-N'-(9-octadecenyl)urea, N-(3-allyl-4-hydroxyphenyl)-N'-ocLadecylurea, N-(2-hydroxyphenyl)-N'-octylurea, N-(3-hydroxyphenyl)-N'-octadecylurea, N-(3,4-dihydroxyphenyl)-N'-octadecylurea, N-(3,4,5-trihydroxyphenyl)-N'-tricosylurea, N-(4-hydroxyphenyl)-N'-(4-tetradecylphenyl)urea, N-(4-hydroxyphenyl)-N'-hexadecylthiourea, N-(4-hydroxyphenyl)-N'-octadecylthiourea, 4-undecanoylamino-1-(4-hydroxyphenylaminocarbonyl)benzene, 4-octadecanoylamino-1-(4-hydroxyphenylaminocarbonyl) benzene, 4-(octadecylaminocarbonyl)amino-1-(4-hydroxyphenylaminocarbonyl)benzene, 4-octadecylamino-1-(4-hydroxyphenylamino)carbonylmethylbenzene, N-octadecenyl-N'-p-(4-hydroxyphenylcarbamoyl) phenyloxamide, 4-(octadecylaminocarbonyl)amino-1-(4-hydroxyphenylcarbamoyl)methylbenzene, 4-(octadecylamino)carbonyl-1-(4-hydroxyphenylcarbamoyl)methylbezene, N-octadecanoyl-N'-p-(p-hydroxyphenylcarbamoylmethyl)benzoylhydrazine, N-dodecanoyl-N'-p-[2-(p-hydroxyphenylcarbamoyl)ethyl] benzoylhydrazine, N-(4-hydroxyphenylmethyl)-N'-n-tetradecylurea, N-(4-hydroxyphenylmethyl)-N'-n-octadecylurea, N-[2-(4-hydroxyphenyl)ethyl]-N'-n-tetradecylurea, N-[2-(4-hydroxyphenyl)ethyl]-N'-n-octadecylurea, N-[3-(4-hydroxyphenyl)propyl]-N'-n-dodecylurea, N-[3-(4-hydroxyphenyl)propyl]-N'-n-octadecylurea, N-[6-(4-hydroxyphenyl)hexyl]-N'-n-dodecylurea, N-[2-(3-hydroxyphenyl)-ethyl]-N'-n-octadecylurea, N-[2-(3,4-dihydroxyphenyl)-ethyl]-N'-n-octadecylurea, N-n-octadecyl-(4-hydroxyphenyl)-acetamide, N-n-dodecyl-3-(4-hydroxyphenyl)propanamide, N-n-octadecyl-3-(4-hydroxyphenyl)propaneamide, N-(4-hydroxyphenylmethyl)octadecanamide, N- [2-(4-hydroxyphenyl)ethyl]octadecaneamide, N-[3-(4-hydroxyphenyl)propyl]octadecanamide, N-[3-(3-hydroxyphenyl)propyl]octadecanamide, N-[3-(3,4-dihydroxyphenyl)propyl]octadecanamide, N-(4-hydroxybenzoyl)-N'-n-octanoylhydrazine, N-(4-hydroxybenzoyl)-N'-n-tetradecanoylhydrazine, N-(4-hydroxybenzoyl)-N'-n-octadecanoylhydrazine, N-(2,4-dihydroxybenzoyl)-N'-n-octanoylhydrazine, N-(2,4-dihydroxybenzoyl)-N'-n-octadecanoylhydrazine, N-(4-hydroxybenzoyl)-N'-n-tetradecylaminocarbonylhydrazine, N-(4-hydroxybenzoyl)-N'-n-octadecylaminocarbonylhydrazine, N-(2,4-dihydroxybenzoyl)-N'-n-tetradecylaminocarbonylhydrazine, N-(2,4-dihydroxybenzoyl)-N'-n-octadecylaminocarbonylhydrazine, N-(4-hydroxybenzoyl)-N'-n-octyloxycarbonylhydrazine, N-(4-hydroxybenzoyl)-N'-n-dodecyloxycarbonylhydrazine, N-(2,4-dihydroxybenzoyl)-N'-n-tetradecyloxycarbonylhydrazine, N-(2,4-dihydroxybenzoyl)-N'-n-octadecyloxycarbonylhydrazine, N-(4-hydroxybenzoyl)-N'-n-tetradecylhydrazinocarbonylhydrazine, N-(4-hydroxybenzoyl)-N'-n-octadecylhydrazinocarbonylhydrazine, N-(2,4-dihydroxybenzoyl)-N'-n-tetradecylhydrazinocarbonylhydrazine, N-(2,4-dihydroxybenzoyl)-N'-n-octadecylhydrazinocarbonylhydrazine, N-(4-hydroxybenzoyl)-N'-n-octanoylmethylenediamine, N-(4-hydroxybenzoyl)-N'-n-tetradecanoylmethylenediamine, N-(4-hydroxybenzoyl)-N'-n-octadecanoylmethylenediamine, N-(2,4-dihydroxybenzoyl)-N'-n-tetradecanoylmethylenediamine, N-(2,4-dihydroxybenzoyl)-N'-n-octadecanoylmethylenediamine, N-(4-hydroxybenzoyl)-N'-n-octylaminocarbonylmethylenediamine, N-(4-hydroxybenzoyl)-N'-n-dodecylaminocarbonylmethylenediamine, N-(4-hydroxybenzoyl)-N'-n-Letradecylaminocarbonylmethylenediamine, N-(4-hydroxybenzoyl)-N'-n-octadecylaminocarbonylmethylenediamine, N-(2,4-dihydroxybenzoyl)-N'-n-octadecylaminocarbonylmethylenediamine, N-(4-hydroxybenzoyl)-N'-n-tetradecyloxycarbonylmethylenediamine, N-(4-hydroxybenzoyl)-N'-n-octadecyloxycarbonylmethylenediamine, N-(2,4-dihydroxybenzoyl)-N'-n-Letradecyloxycarbonylmethylenediamine, N-(2,4-dihydroxybenzoyl)-N'-n-octadecyloxycarbonylmethylenediamine, N-(4-hydroxybenzoyl)-N'-n-octylhydrazinocarbonylmethylenediamine, N-(4-hydroxybenzoyl)-N'-n-dodecylhydrazinocarbonylmethylenediamine, N-(2,4-dihydroxybenzoyl)-N'-n-tetradecylhydrazinocarbonylmethylenediamine, N-(2,4-dihydroxybenzoyl)-N'-n-octadecylhydrazinocarbonylmethylenediamine, N-n-octadecyl-2-(p-hydroxyphenylthio)acetamide, N-n-octadecyl-3-(p-hydroxyphenylthio)propanamide, N-n-decyl11-(p-hydroxyphenylthio)undecanamide, N-(p-n-ocLylphenyl)6-(p-hydroxyphenylthio)hexanamide, N-n-octadecyl-p-(p-hydroxyphenylthio)benzamide, N-[2-(p-hydroxyphenylthio)ethyl]-n-octadecanamide, N-[p-(p-hydroxyphenylthio)phenyl]-n-octadecanamide, N-(p-hydroxyphenylthio)methyl-N'-n-octadecylurea, N-[2-(p-hydroxyphenylthio)ethyl]-N'-n-tetradecylurea, N-[2-(p-hydroxyphenylthio)ethyl]-N'-n-octadecylurea, N-[2-(3,4-dihydroxyphenylthio)ethyl]-N'-n-octadecylurea, N-[p-(p-hydroxyphenylthio)phenyl]-N'-n-octadecylurea, N-[10-(p-hydroxyphenylthio)decyl]-N'-n-decylurea, n-octadecyl N-[2-(p-hydroxyphenylthio)ethyl]carbamate, n-dodecyl N-[p-(p-hydroxyphenylthio)phenyl]carbamate, [2-(p-hydroxyphenylthio)ethyl]N-n-octadecylcarbamate, N-[3-(p-hydroxyphenylthio)propionyl]-N-n-octadecanoylamine, N-[2-(p-hydroxyphenylthio)aceto]-N'-n-octadecanohydrazide, N-[3-(p-hydroxyphenylthio)propiono]-N'-n-octadecanohydrazide, N-[3-(3,4-dihydroxyphenylthio)propiono]-N'-n-octadecanohydrazide, N-[6-(p-hydroxyphenylthio)hexano]-N'-n-octadecanohydrazide, N-[6-(p-hydroxyphenylthio)hexano]-N'-(p-noctylbenzo)hydrazide, N-[ll-(p-hydroxyphenylthio)undecano]-N'-n-decanohydrazide, N-[11-(p-hydroxyphenylthio)undecano]-N'-n-tetradecanohydrazide, N-[11-(p-hydroxyphenylthio)undecano]-N'-n-octadecanohydrazide, N-[ll-(p-hydroxyphenylthio)undecano]-N'-(6-phenyl)hexanohydrazide, N-[11-(3,4,5-trihydroxyphenylthio)undecano]-N'-n-octadecanohydrazide, N-[p-(p-hydroxyphenylthio)benzo]-N'-n-octadecanohydrazide, N-[p-(p-hydroxyphenylthiomethyl)benzo]-N'-n-octadecanohydrazide, N-[3-(p-hydroxyphenylthio)propyl]-N'-n-octadecyloxamide, N-[3-(3,4-dihydroxyphenylthio)propyl]-N'-n-octadecyloxamide, N-[11-(p-hydroxyphenylthio)undecyl]-N'-n-decyloxamide, N-[p-(p-hydroxyphenylthio)phenyl]-N'-n-octadecyloxamide, N-[2-(p-hydroxyphenylthio)acetyl]-N'-n-octadecylurea, N-[3-(p-hydroxyphenylthio)propyl]-N'-n-octadecylurea, N-[2-(p-hydroxyphenylthio)ethyl]-N'-n-octadecanoylurea, N-[p-(p-hydroxyphenylthio)phenyl]-N'-n-octadecanoylurea, n-octadecyl 3-[3-(p-hydroxyphenylthio)propyl]carbazide, 4-[2-(p-hydroxyphenylthio)ethyl]-4-n-octadecylsernicarbazide, 1-[p-(p-hydroxyphenylthio)phenyl]-4-n-tetradecylsemicarbazide, 1-[3-(p-hydroxyphenylthio)propionyl]-4-n-octadecylsemicarbazide, 1-[p-(p-hydroxyphenylthio)benzoyl]-4-n-octadecylsemicarbazide, 4-[2-(p-hydroxyphenylthio)ethyl]-1-n-tetradecanoylsemicarbazide, 4-[p-(p-hydroxyphenylthio)phenyl]-1-n-octadecanoylsemicarbazide, 1-[2-(p-hydroxyphenylthio)acetamido]-1-n-octadecanoylaminomethane, 1-[11-(p-hydroxyphenylthio)undecanamido]-N'-n-decanoylaminomethane, 1-[p-(p-hydroxyphenylthio)benzamido]-1-n-octadecanoylaminomethane, 1-[3-(p-hydroxyphenylthio)propanamido]-l-(N'-n-octadecylureido)methane, 1-[ll-(p-hydroxyphenylthio)undecanamido]-N'-(N'-n-decylureido)methane, 1-{N'-[2-(p-hydroxyphenylthio)ethyl]-ureido}-1-n-octadecanoylaminomethane, N-[2-(p-hydroxyphenylthio)-ethyl]-N'-n-octadecylmalonamide, n-octadecyl N-[2-(p-hydroxyphenyl)-ethyl]carbamate, [2-(p-hydroxyphenyl)ethyl]N-n-octadecylcarbamate, N-[3-(p-hydroxyphenyl)-propionyl]-N-n-octadecanoylamine, N-[6-(p-hydroxyphenyl)-hexanoyl]-N-n-octadecanoylamine, N-[3-(p-hydroxyphenyl)-propionyl]-N-(p-n-octylbenzoyl)amine, N-[2-(p-hydroxyphenyl)aceto]-N'-n-dodecanohydrazide, N-[2-(p-hydroxyphenyl)aceto]-N'-n-octadecanohydrazide, N-[3-(p-hydroxyphenyl)propiono]-N'-n-octadecanohydrazide, N-[3-(p-hydroxyphenyl)propiono]-N'-n-docosanohydrazide, N-[6-(p-hydroxyphenyl)hexano]-N'-n-tetradecanohydrazide, N-[6-(p-hydroxyphenyl)hexano]-N'-n-octadecanohydrazide, N-[6-(p-hydroxyphenyl)hexano]-N'-(p-n-octylbenzo)hydrazide, N-[11-(p-hydroxyphenyl)undecano]-N'-n-decanohydrazide, N-[11-(p-hydroxyphenyl)undecano]-N'-n-octadecanohydrazide, N-(p-hydroxybenzo)-N'-n-octadecanohydrazide, N-[p-(p-hydroxyphenyl)benzo]-N'-n-octadecanohydrazide, N-[p-(p-hydroxyphenylmethyl)benzo]-N'-n-octadecanohydrazide, N-[3-(phydroxyphenyl)propyl]-N'-n-octadecyloxamide, N-[3-(3,4-dihydroxyphenyl)propyl]-N'-n-octadecyloxamide, N-[p-(p-hydroxyphenyl)phenyl]-N'-n-octadecyloxamide, N-[2-(p-hydroxyphenyl)acetyl]-N'-n-octadecylurea, N-[2-(p-hydroxyphenyl)ethyl]-N'-n-octadecylurea, N-[3-(p-hydroxyphenyl)proponyl]-N'-n-octadecylurea, N-[p-(p-hydroxyphenyl)benzoyl]-N'-n-octadecylurea, N-[2-(p-hydroxyphenyl)ethyl]-N'-n-octadecanoylurea, 4-[2-(p-hydroxyphenyl)ethyl]-1-n-octadecylsemicarbazide, 1-[2-(p-hydroxyphenyl)ethyl]-4-n-tetradecylsemicarbazide, 1-[2-(p-hydroxyphenyl)ethyl]-4-n-octadecylsemicarbazide, 1-[2-(p-hydroxyphenyl)acetyl]-4-n-tetradecylsemicarbazide, 1-[3-(p-hydroxyphenyl)propionyl]-4-n-octadecylsemicarbazide, 1-[11-(p-hydroxyphenyl)undecanoyl]-4-n-decylsemicarbazide, 4-[2-(p-hydroxyphenyl)ethyl]-1-n-octadecanoylsemicarbazide, 4-[p-(p-hydroxyphenyl)phenyl]-1-n-octadecanoylsemicarbazide, 1-[2-(p-hydroxyphenyl)acetamido]-1-n-octadecanoylaminomethane, 1-[3-(p-hydroxyphenyl)propanamido]-1-n-octadecanoylaminomethane, 1-[2-(p-hydroxyphenyl)acetamido]-1-(3-n-octadecylureido)methane, 1-[3-(p-hydroxyphenyl)propanamido]-1-(3-n-octadecylureido)methane, 1-[11-(p-hydroxyphenyl)undecanamido]-1-(3-n-decylureido)methane, 1-{3-[2-(p-hydroxyphenyl)ethyl]ureido}-1-n-octadecnoylaminomethane, N-[2-(p-hydroxyphenyl)ethyl]-N'-n-octadecylmalonamide, 4-n-octadecylaminophenol, 4-(1-octadecynyl)phenol, 4-(1,3-octadecadiynyl)-phenol, and the like.

These reversible color developing agents may be used alone or in combination of two or more, and generally used in an amount of 5 to 5000% by weight, preferably 10to 3000% by weight based on the weight of the colorless or slightly colored leuco dyes.

Also, for controlling a color formation sensitivity and decolorizing temperature of the reversible heat-sensitive recording layer, a heat meltable substance having a melting point of 60° C. to 200° C., preferably 80° C. to 180° C. may be contained in the reversible heat-sensitive recording layer as an additive. Sensitizers used for the general heat-sensitive recording paper can also be used. Examples of the heat meltable substances include waxes such as N-hydroxymethylstearamide, stearamide and palmitamide; naphthol derivatives such as 2-benzyloxynaphthalene; biphenyl derivatives such as p-benzylbiphenyl and 4-allyloxybiphenyl; polyether compounds such as 1,2-bis(3-methylphenoxy)ethane, 2,2'-bis(4-methoxyphenoxy)diethyl ether and bis(4-methoxyphenyl) ether; and carbonic acid or oxalic acid diester derivatives such as diphenyl carbonate, dibenzyl oxalate and bis(p-methylbenzyl)oxalate. These may be used each alone or in combination of two or more but not limited by these.

Moreover, in the reversible heat-sensitive recording layer, the anchor layer, the protective layer or the intermediate layer, higher aliphatic acid metal salts such as zinc stearate and calcium stearate; waxes such as paraffin, oxidized paraffin, polyethylene, oxidized polyethylene, steramide and castor wax; and dispersants such as sodium dioctylsulfosuccinate, and further surfactants, fluroescent dyes, etc. may be contained.

The support to be used for the reversible heat-sensitive recording layer of the present invention, there may be optionally used paper, coated paper, various nonwoven fabrics, woven fabrics, synthetic resin films, synthetic resin laminated papers, synthetic papers, metallic foils, glasses and composite sheets comprising the combination of them. These are not limitative. The thickness of the support is not particularly limited so long as it can endure for repeated use, but generally about 20 to 1300 $\mu$m, preferably about 40 to 1000 $\mu$m.

In the layer structure of the reversible heat-sensitive recording layer of the present invention, a material which can electrically, magnetically or optically record the information may be contained in the reversible heat-sensitive recording layer, other layers, or the side on which the reversible heat-sensitive recording layer is provided or the reverse side thereof. Also, a backcoat layer may be provided on the side reverse to the side on which the reversible heat-sensitive recording layer is provided, for curling inhibition and antistatic purposes, and further, tackifying treatment may be performed.

A method for forming the respective layers constituting the reversible heat-sensitive recording layer of the present invention on the support is not particularly limited, and the layers can be formed by the conventionally known method. For example, it may be used a coating apparatus such as air knife coater, blade coater, bar coater, curtain coater, etc., various kinds of printing machines by the system of lithographic, relief, intaglio, flexographic, gravure, screen or hot melt, etc. Further, in addition to the usual drying procedure, respective layers can be retained by UV (ultraviolet) irradiation or EB (electron-beam) irradiation. According to the above methods, each of the layers may be coated or printed, or a plural number of layers may be coated or printed simultaneously.

In the reversible heat-sensitive recording material of the present invention, the color formation can be brought about when a rapid cooling occurs subsequent to the heating and the decolorization can occur when the cooling rate after the heating is slow. For example, color formed state can be revealed by rapidly cooling the material, e.g., pushing a low temperature metal block to the material, after heating the same by a suitable method. Also, when the material is heated extremely short time by using a thermal head or a laser beam, etc., the material is cooled immediately after completion of the heating so that the color formation state can be retained. On the other hand, when the recording material is heated for a relatively long time by a suitable heat source (thermal head, laser beam, hot roll, hot stamping, high frequency heating, electrical heater, radiant heat from a light source such as tungsten lamp or halogen lamp, hot air or the like), since not only the recording layer, but also the support are heated, the cooling rate becomes slow to result in phase separation state (decolorized state). Accordingly, even when the same heat temperature and/or the same heat source is/are employed, color formation state and decolorized state can be optionally revealed by controlling the cooling rate.

EXAMPLES

In the following, the present invention is explained in more detail by referring to Examples. In Examples, all the parts mean "parts by weight".

Example 1

(A) Preparation of a coating solution for forming a reversible heat-sensitive recording layer 4 parts of 3-di-n-butylamino-6-methyl-7-anilinofluoran which is a leuco dye, 20 parts of N-[3-(p-hydroxyphenyl)-propiono]-N'-n-octadecanohydrazide as a reversible color developing agent, 12 parts of a vinyl chloride resin as a binder resin and 100 parts of toluene as a solvent were mixed, and the mixture was milled in a ball mill for 24 hours to obtain a dispersion. Also, 2 parts of silica (trade name: Nip Seal, available from Nippon Silica Co.) as a pigment, 0.1 part of γ-mercaptopropyltrimethoxysilane as a surface modifier and 15 parts of toluene as a solvent were mixed, and the mixture was milled in a ball mill for 24 hours to obtain a pigment dispersion. The above two kinds of dispersions were mixed to prepare a reversible heat-sensitive coating solution.

(B) Coating of a Reversible Heat-Sensitive Recording Material

The reversible heat-sensitive coating solution prepared in (A) was coated on a polyethylene terephthalate (PET) sheet at a coating weight (solid matter) of 5 g/m$^2$ and dried. Then, heat treatment was carried out at 100° C. for one hour and then the coated sheet was subjected to supercalendering to obtain a coated sheet B.

(C) Coating of a protective layer

On the coated layer of the coated sheet B obtained in (B) was coated a ultraviolet ray curable resin in which 90 parts of Aronix M8030 (trade name, available from Toa Gosei Kagaku Kogyo Co.), 5 parts of N-vinyl-2-pyrrolidone, 5 parts of Irgacure 500 (trade name, available from Nippon Ciba-Geigy Co.) and 5 parts of Mizukasil P-527 (trade name, available from Mizusawa Kagaku Co.) had been mixed at a coating weight (solid matter) of 3.0 g/m$^2$, and then, curing was carried out by a UV-irradiating apparatus (available from Ushio Denki Co., Rapid Cure, trade name). Next, the coated sheet was subjected to heat treatment at 100° C. for one hour to obtain a reversible heat-sensitive recording material having a protective layer.

Example 2

In the same manner as in Example 1 except for changing the surface modifier in the preparation of the reversible heat-sensitive coating solution (A) in Example 1 to 0.1 part of γ-isocyanate propyltriethoxysilane, a reversible heat-sensitive recording material was prepared.

Example 3

In the same manner as in Example 1 except for changing the surface modifier in the preparation of the reversible heat-sensitive coating solution (A) in Example 1 to 0.1 part of isopropyl tri(N-aminoethyl-aminoethyl) titanate, a reversible heat-sensitive recording material was prepared.

Example 4

In the same manner as in Example 1 except for changing the surface modifier in the preparation of the reversible heat-sensitive coating solution (A) in Example 1 to 0.1 part of acetoalkoxyaluminum isopropylate, a reversible heat-sensitive recording material was prepared.

Example 5

In the same manner as in Example 1 except for changing the surface modifier in the preparation of the reversible heat-sensitive coating solution (A) in Example 1 to 0.1 part of kaolin (trade name: NUCLAY), a reversible heat-sensitive recording material was prepared.

Example 6

In the same manner as in Example 1 except for changing the binder resin in the preparation of the reversible heat-sensitive coating solution (A) in Example 1 to 20 parts of an acrylic resin (trade name: Acrydic 56–834, available from DIC Co.) and changing the surface modifier to 0.1 part of N-β-(aminoethyl)-γ-aminopropyltrimethoxysilane, a reversible heat-sensitive recording material was prepared.

Example 7

In the same manner as in Example 1 except for changing the coating of the reversible heat-sensitive recording material (B) of Example 1 as mentioned below, a reversible heat-sensitive recording material was prepared.

(B) Coating of a reversible heat-sensitive recording material.

10 parts of a vinyl chloride resin (trade name: VAGH, available from Union Carbide Co.), 0.3 part of silica (trade name: SYLOPHOBIC, available from Fuji Silicia Kagaku Co.) as a pigment and 90 parts of toluene as a solvent were mixed. This mixture was coated on a polyethylene terephthalate (PET) sheet at a coating weight (solid matter) of 1 g/m$^2$ as an anchor layer. Next, the reversible heat-sensitive coating solution prepared in (A) of Example 1 was coated on the anchor layer at a coating weight (solid matter) of 5 g/m$^2$ and dried. Then, heat treatment was carried out at 100° C. for one hour and then the coated sheet was subjected to super-calendering to obtain a coated sheet B.

Example 8

In the same manner as in Example 1 except for further adding 0.1 part of vinyl triethoxysilane to the coating solution for forming the protective layer in (C) of Example 1 as mentioned above, a reversible heat-sensitive recording material was prepared.

Comparative Example 1

In the same manner as in Example 1 except for not using the surface modifier in the preparation of the reversible heat-sensitive coating solution (A) of Example 1, a reversible heat-sensitive recording material was prepared.

Comparative Example 2

In the same manner as in Example 7 except for coating a coating solution prepared by not using a surfactant of the reversible heat-sensitive coating solution (A) prepared in Example 1 on the anchor layer, a reversible heat-sensitive recording material was prepared.

Comparative Example 3

In the same manner as in Example 1 except for not using the surface modifier in the preparation of the reversible heat-sensitive coating solution (A) of Example 1 and adding 0.1 part of sodium alkylsulfosuccinate as a dispersant, a reversible heat-sensitive recording material was prepared.

The thus prepared reversible heat-sensitive recording materials were evaluated by Lhe following tests.

Test Method

By using the reversible heat-sensitive recording materials prepared in Examples and Comparative examples, printing was carried out by a thermal head with 8 dots/mm available from Kyocera Co. under the conditions of an applied pulse width of 2.0 msec and an applied voltage of 21 volts, and the resulting colored images were measured by a densitometer Macbeth RD918 (trade name, available from Gretag Macbeth, GB) as a color density. Further, a hot stamp was pressed to the resulting colored image portion and heated at 120° C. for 1 second to decolorize and the density was measured in the same manner to obtain a decolorization density. Moreover, color formation and decolorization were repeated 20 times and then the colored density and decolorized density were measured. Also, the portion at which printing was carried out 20 times repeatedly was observed by an optical microscope and the degree of damages at the print-recording surface was evaluated. Evaluation standards are as follows.

O: No damage was observed at the recording surface and the surface is good

O: Slight printing damage was admitted at the recording surface but practically no problem X: A number of breakage and damages were admitted at the print-recording surface

TABLE 1

| | First time | | 20th time | | Evaluation of damage |
|---|---|---|---|---|---|
| | Colored portion | Decolorized portion | Colored portion | Decolorized portion | on repeated use |
| Example 1 | 1.30 | 0.08 | 1.29 | 0.10 | ○ |
| Example 2 | 1.25 | 0.10 | 1.26 | 0.11 | ○ |
| Example 3 | 1.30 | 0.12 | 1.25 | 0.13 | ○ |
| Example 4 | 1.28 | 0.07 | 1.00 | 0.08 | ○ |
| Example 5 | 1.24 | 0.07 | 1.18 | 0.07 | ◎ |
| Example 6 | 1.16 | 0.07 | 1.15 | 0.07 | ◎ |
| Example 7 | 1.32 | 0.07 | 1.33 | 0.07 | ◎ |
| Example 8 | 1.27 | 0.07 | 1.30 | 0.07 | ◎ |
| Comparative example 1 | 1.34 | 0.07 | 0.88 | 0.21 | X |
| Comparative example 2 | 1.19 | 0.10 | 0.71 | 0.20 | X |
| Comparative example 3 | 1.18 | 0.08 | 0.70 | 0.20 | X |

From the results shown in Table 1, it can be understood that Examples 1 to 4 in which surface modifiers are incorporated in the reversible heat-sensitive recording layer show excellent in color formation and decolorization, have good image contrast and sufficient durability. Also, Examples 7 and 8 in which surface modified pigments are used in the anchor layer or the intermediate layer show particularly excellent repeated uses and no lowering in color forming density was admitted so that it can be understood that these samples are particularly excellent. Also, in Examples 5 and 6 in which the pigment and/or the binder are changed, good color formation and decolorization are obtained, it is possible to carry out color formation and decolorization repeatedly and durability is also sufficient. On the other hand, in Comparative examples 1, 2 and 3, sufficient color formation density and decolorization density can be obtained, but contrast of the image is markedly lowered and remarkable breakage of the recording layer which is due to thermal head was observed. According to these, it can be admitted clear difference between Examples and Comparative examples, and it is confirmed that the present invention shows remarkably excellent effects.

The reversible heat-sensitive recording material of the present invention can form a color by a thermal energy of thermal head, etc. and can make a decolorized state the color formed state composition by heating again. Further, such a color formation and decolorization can be performed repeatedly, and the color formed state and the decolorized state can be maintained at room temperature. Moreover, in the reversible heat-sensitive recording material of the present invention, by adding a surface-treated pigment in the reversible heat-sensitive recording layer, or in the protective layer provided thereon, or in the anchor layer between the support and the reversible heat-sensitive recording layer, a reversible heat-sensitive recording material which is satisfied for practical use can be supplied without suffering from any damage by the repeated use of color formation and decolorization.

I claim:

1. A reversible heat-sensitive recording material having a support and a reversible heat-sensitive recording layer provided at least one surface of the support and containing a colorless or slightly colored leuco dye and a reversible color developing agent capable of causing a reversible change in color density of said dye due to the difference in cooling rate after heating, characterized in that the reversible heat-sensitive recording layer contains a pigment subjected to a surface-modifying treatment by at least one of a silane coupling agent, a titanate coupling agent and an aluminum coupling agent.

2. The reversible heat-sensitive recording material according to claim 1, wherein a protective layer is further provided on the reversible heat-sensitive recording layer.

3. The reversible heat-sensitive recording material according to claim 2, wherein the protective layer contains a pigment subjected to a surface-modifying treatment.

4. The reversible heat-sensitive recording material according to claim 3, wherein said pigment is treated by at least one of a silane coupling agent, a titanate coupling agent and an aluminum coupling agent.

5. The reversible heat-sensitive recording material according to claim 3, wherein said pigment is silica which is treated by a silane coupling agent.

6. The reversible heat-sensitive recording material according to claim 3, wherein said pigment is silica having an average particle size of 1 μm or less which is treated by a silane coupling agent having a mercapto group.

7. The reversible heat-sensitive recording material according to claim 1, wherein an anchor layer is further provided between the support and the reversible heat-sensitive recording layer.

8. The reversible heat-sensitive recording material according to claim 7, wherein the anchor layer contains a pigment subjected to a surface-modifying treatment.

9. The reversible heat-sensitive recording material according to claim 8, wherein said pigment is treated by at least one of a silane coupling agent, a titanate coupling agent and an aluminum coupling agent.

10. The reversible heat-sensitive recording material according to claim 8, wherein said pigment is silica which is treated by a silane coupling agent.

11. The reversible heat-sensitive recording material according to claim 8, wherein said pigment is silica having an average particle size of 1 μm or less which is treated by a silane coupling agent having a mercapto group.

12. The reversible heat-sensitive recording material according to claim 1, wherein said pigment is silica which is treated by a silane coupling agent.

13. The reversible heat-sensitive recording material according to claim 1, wherein said pigment is silica having an average particle size of 1 μm or less which is treated by a silane coupling agent having a mercapto group.

14. The reversible heat-sensitive recording material according to claim 1, wherein said silane coupling agent is at least one selected from the group consisting of vinyl silane compounds, epoxysilane compounds, aminosilane compounds, and reactive silane compounds.

15. The reversible heat-sensitive recording material according to claim 1, wherein said silane coupling agent is at least one selected from the group consisting of vinyl triethoxysilane, vinyl trichlorosilane, vinyl trimethoxysilane, vinyl tris(β-methoxyethoxy)silane, γ-methacryloxypropyldimethoxysilane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, γ-aminopropyltrimethoxysilane, N-β-(aminoethyl)-γ-aminopropyltrimethoxysilane, N-β-(aminoethyl)-γ-aminopropyldimethoxysilane, γ-phenylaminopropyltrimethoxysilane, γ-mercaptopropyltrimethoxysilane, γ-isocyanatepropyltriethoxysilane, γ-methacryloxypropyltrimethoxysilane, γ-methacryloxypropyltriethoxysilane and ureidopropyltriethoxysilane.

16. The reversible heat-sensitive recording material according to claim 1, wherein said titanate coupling agent is at least one selected from the group consisting of isopropyltriisostearoyltitanate, isopropyltris(dioctylpyrophosphate)titanate, isopropyltri(N-aminoethyl-aminoethyl)titanate, tetraoctylbis(ditridecylphosphate)titanate, tetra(2,2-diallyloxymethyl-1-butyl)bis(ditridecyl)phosphatetitanate, bis(dioctylpyrophosphate)oxyacetatetitanate, and bis(dioctylpyrophosphate)ethylenetitanate.

17. The reversible heat-sensitive recording material according to claim 1, wherein said aluminum coupling agent is acetalkoxyaluminum diisopropylate.

* * * * *